US007160010B1

(12) United States Patent
Chinniah et al.

(10) Patent No.: US 7,160,010 B1
(45) Date of Patent: Jan. 9, 2007

(54) LIGHT MANIFOLD FOR AUTOMOTIVE LIGHT MODULE

(75) Inventors: Jeyachandrabose Chinniah, Canton, MI (US); Amir P. Fallahi, W. Bloomfield, MI (US); Jeffrey Allen Erion, Plymouth, MI (US); Edwin Mitchell Sayers, Saline, MI (US); Thomas Lee Jones, Commerce Township, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/274,609

(22) Filed: Nov. 15, 2005

(51) Int. Cl.
*F21V 9/00* (2006.01)

(52) U.S. Cl. ..... 362/511; 362/616; 362/623; 362/625

(58) Field of Classification Search ..... 362/600, 362/615, 612, 616, 623, 625, 555, 511
See application file for complete search history.

(56) References Cited

U.S. PATENT DOCUMENTS

| | | | |
|---|---|---|---|
| 2,215,900 | A | 9/1940 | Bitner |
| 2,224,178 | A | 12/1940 | Bitner |
| 2,254,961 | A | 9/1941 | Harris |
| 2,254,962 | A | 9/1941 | Harris et al. |
| 2,387,816 | A | 10/1945 | Wagner |
| 3,593,014 | A | 7/1971 | Vesely |
| 3,700,883 | A | 10/1972 | Donohue et al. |
| 4,344,110 | A | 8/1982 | Ruediger |
| 4,389,698 | A | 6/1983 | Cibie |
| 4,577,260 | A | 3/1986 | Tysoe |
| 4,613,927 | A | 9/1986 | Brandt |
| 4,642,740 | A | 2/1987 | True |
| 4,704,661 | A | 11/1987 | Kosmatka |
| 4,753,520 | A | 6/1988 | Silverglate |
| 4,770,514 | A | 9/1988 | Silverglate |
| 4,826,273 | A | 5/1989 | Tinder et al. |
| 4,927,248 | A | 5/1990 | Sakakibara et al. |
| 4,958,263 | A | 9/1990 | Davenport et al. |
| 4,972,302 | A | 11/1990 | Masuyama et al. |
| 5,042,928 | A | 8/1991 | Richards |
| 5,081,564 | A | 1/1992 | Mizeguchi et al. |
| 5,161,059 | A | 11/1992 | Swanson et al. |
| 5,184,883 | A | 2/1993 | Finch et al. |
| 5,276,594 | A | 1/1994 | Burkett et al. |
| 5,311,410 | A | 5/1994 | Hsu et al. |
| 5,343,330 | A | 8/1994 | Hoffman et al. |
| 5,369,554 | A | 11/1994 | Erion |
| 5,434,756 | A | 7/1995 | Hsu et al. |
| 5,440,456 | A | 8/1995 | Bertling et al. |

(Continued)

FOREIGN PATENT DOCUMENTS

| | | | |
|---|---|---|---|
| DE | 3317519 | A1 | 11/1948 |

(Continued)

OTHER PUBLICATIONS

Product Brochure—The Led Light.com; Luxeon LEDs, Assemblies, and Accessories; pp. 1-4, Jul. 27, 2005.

(Continued)

*Primary Examiner*—Laura K. Tso
(74) *Attorney, Agent, or Firm*—Brinks Hofer Gilson & Lione

(57) ABSTRACT

A light manifold for an automotive light module emitting light to the side of a longitudinal axis along which light is to be directed. The light module is structured in a manner that permits the creation of light distribution patterns for particular functions, such as the stop light function for an automobile, that are otherwise difficult to effectively produce.

20 Claims, 3 Drawing Sheets

U.S. PATENT DOCUMENTS 5,485,317 A 1/1996 Perissinotto et al.
5,526,190 A 6/1996 Hubble, III et al.
5,532,909 A 7/1996 Ban et al.
5,567,031 A 10/1996 Davenport et al.
5,577,492 A 11/1996 Parkyn, Jr. et al.
5,608,290 A 3/1997 Hutchisson et al.
5,642,933 A 7/1997 Hitora
5,757,557 A 5/1998 Medvedev et al.
5,775,792 A 7/1998 Wiese
5,813,743 A 9/1998 Naka
5,898,267 A 4/1999 McDermott
5,914,760 A 6/1999 Daiku
5,931,576 A 8/1999 Kreysar et al.
5,947,587 A 9/1999 Keuper et al.
6,007,226 A 12/1999 Howard
6,075,652 A 6/2000 Ono et al.
6,097,549 A 8/2000 Jenkins et al.
6,123,440 A 9/2000 Albou
6,129,447 A 10/2000 Futami
6,139,147 A 10/2000 Zhang
6,152,588 A 11/2000 Scifres
6,168,302 B1 1/2001 Hulse
6,191,889 B1 2/2001 Maruyama
6,206,554 B1 3/2001 Schuster et al.
6,283,623 B1 9/2001 Chinniah et al.
6,292,293 B1 9/2001 Chipper
6,305,830 B1 10/2001 Zwick et al.
6,327,086 B1 12/2001 Unno
6,334,702 B1 1/2002 Albou
6,352,359 B1 3/2002 Shie et al.
6,356,394 B1 3/2002 Glienicke
6,367,950 B1 4/2002 Yamada et al.
6,367,954 B1 4/2002 Futami
6,367,957 B1 4/2002 Hering et al.
6,402,355 B1 6/2002 Kinouchi
6,431,738 B1 8/2002 Kondo et al.
6,447,155 B1 9/2002 Kondo et al.
6,454,443 B1 9/2002 Natsume et al.
6,462,874 B1 10/2002 Soskind
6,481,864 B1 11/2002 Hosseini et al.
6,527,411 B1 3/2003 Sayers
6,536,918 B1 3/2003 Boroczki et al.
6,543,923 B1 4/2003 Tamai
6,547,423 B1 4/2003 Marshall et al.
6,560,038 B1 5/2003 Parkyn, Jr. et al.
6,604,843 B1 8/2003 Shpizel
6,616,299 B1 9/2003 Martineau
6,616,305 B1 9/2003 Simon
6,623,132 B1 9/2003 Lekson et al.
6,626,565 B1 9/2003 Ishida
6,679,618 B1 1/2004 Suckow et al.
6,698,908 B1 3/2004 Sitzema, Jr. et al.
6,724,543 B1 4/2004 Chinniah et al.
6,726,346 B1 4/2004 Shoji
6,755,556 B1 6/2004 Gasquet et al.
6,757,109 B1 6/2004 Bos
6,783,269 B1 8/2004 Pashley et al.
6,805,456 B1 10/2004 Okuwaki
6,807,019 B1 10/2004 Takeuchi et al.
6,814,475 B1 11/2004 Amano
6,814,480 B1 11/2004 Amano
6,819,505 B1 11/2004 Cassarly et al.
6,819,506 B1 11/2004 Taylor et al.
6,824,284 B1 11/2004 Chinniah et al.
6,899,443 B1 5/2005 Rizkin et al.
6,910,783 B1 6/2005 Mezei et al.
2002/0008969 A1 1/2002 Mabuchi et al.
2002/0080615 A1 6/2002 Marshall et al.
2002/0093820 A1 7/2002 Pederson
2002/0126400 A1 9/2002 Muller-Rissmann et al.
2002/0136022 A1 9/2002 Nakata
2002/0167820 A1 11/2002 Haering et al.
2002/0172052 A1 11/2002 Perlo et al.
2003/0007359 A1 1/2003 Sugawara et al.
2003/0067784 A1 4/2003 Erber
2003/0075167 A1 4/2003 Minano Dominguez et al.
2003/0099113 A1 5/2003 Gebauer et al.
2003/0123159 A1 7/2003 Morita et al.
2003/0123262 A1 7/2003 Suehiro et al.
2003/0218882 A1 11/2003 Wirth et al.
2003/0235050 A1 12/2003 West et al.
2004/0012976 A1 1/2004 Amano
2004/0070855 A1 4/2004 Benitez et al.
2004/0109326 A1 6/2004 Uhl
2004/0114393 A1 6/2004 Galli
2004/0120157 A1 6/2004 Bottesch et al.
2004/0130904 A1 7/2004 Yamada et al.
2004/0141323 A1 7/2004 Aynie et al.
2004/0145899 A1 7/2004 Riebling et al.
2004/0150991 A1 8/2004 Ouderkirk et al.
2004/0179349 A1 9/2004 Buelow, II et al.
2004/0202003 A1 10/2004 Lyst, Jr.
2004/0212998 A1 10/2004 Mohacsi
2004/0218392 A1 11/2004 Leadford
2004/0257827 A1 12/2004 Ishida et al.
2004/0264199 A1 12/2004 Shu et al.
2005/0007753 A1 1/2005 Van Hees et al.
2005/0024744 A1 2/2005 Falicoff et al.
2005/0057938 A1 3/2005 Mertens et al.
2005/0078483 A1 4/2005 Bernard et al.
2005/0083699 A1 4/2005 Rhoades et al.

FOREIGN PATENT DOCUMENTS

EP WO 89/08223 8/1989
JP 05205511 8/1993
JP 06260006 9/1994
JP 02001257381 9/2001

OTHER PUBLICATIONS

Product Brochure—Carclo Precision Optics; LED OPTICS; 2 Pages.
DE 3317519 A1—English Abstract—Published Nov. 15, 1984.
JP05205511—English Abstract—Published Aug. 13, 1993.
JP0626006—English Abstract—Published Sep. 16, 1994.
JP02001257381—English Abstract—Published Sep. 21, 2001.
WO 89/08223—English Abstract—Published Aug. 9, 1989.

LIGHT MANIFOLD FOR AUTOMOTIVE LIGHT MODULE

FIELD OF THE INVENTION

The present invention relates generally to automotive light modules and light manifolds therefor, and more particularly relates to light manifolds for near field lenses collecting and directing light laterally relative to the light source.

BACKGROUND OF THE INVENTION

Light emitting diodes (LED's) are fast becoming a preferable light source for automotive lighting applications, as they consume less power but provide light output which is acceptable for such applications. In order to employ LED's for automotive applications, high levels of efficiency must be obtained in both light collection as well as light distribution. Typically, reflectors or lenses or light pipes are utilized to collect and distribute the light for the particular lighting application. Unfortunately, not all automotive applications, such as the stop function of a tail light, have been effectively produced utilizing an LED light source in such reflectors, lenses or light pipes.

Accordingly, there exists a need to provide methods and structures for light distribution which meets the requirements of specialized applications.

BRIEF SUMMARY OF THE INVENTION

One embodiment of the present invention provides a light manifold for a light module which facilitates reproduction of automotive light functions. Generally, the light manifold distributes light from a light source and includes the main body of light transmitting material. The main body defines a longitudinal axis and a lateral axis. The main body has opposing first and second surfaces, the first and second surfaces generally facing longitudinally. The first surface has a series of alternating angled portion and lateral portions. The angled portions are angled relative to both the longitudinal and lateral axes for reflecting light towards the second surface. The lateral portions include a plurality of ridges structured to reflect incident light towards the second surface.

According to more detailed aspects, the lateral portions are generally parallel to the lateral axis and preferably are angled about 45 degrees relative to both the longitudinal and lateral axes. Each angled portion has an upper longitudinal edge and the plurality of ridges have upper longitudinal edges positioned lower than the upper longitudinal edge of an adjacent radially inward angled portion. Preferably, the plurality of ridges are defined by V-shaped grooves formed into the first surface of the main body. The angled portions are positioned sequentially in the longitudinal direction. The main body preferably includes a lateral facing surface receiving light from the light source, and preferably from a near field lens positioned inside the main body and having a flat outer laterally facing surface abutting against the laterally facing surface of the main body.

Another embodiment of the light manifold constructed in accordance with the teachings of the present invention includes a main body of light transmitting material and having a disc shape defining a longitudinal axis. The main body has opposing first and second surfaces generally facing longitudinally. The main body is circumferentially divided into a plurality of wedge sections, each wedge section having a series of radially spaced apart angled portions formed into the first surface. The angled portions are angled relative to the longitudinal axis for reflecting light towards the second surface. The radial spacing of the angled portions of the first wedge section are different than the radial spacing of the angled portions of a second wedge section.

According to more detailed aspects, each wedge section has a radial length, and the radial length of the first wedge section is different than the radial length of the second wedge section. Preferably, the plurality of wedge section alternate between the first and second wedge sections. Each wedge section further includes a series of radially spaced apart inclined sections, the inclined sections being angled relative to the longitudinal axis at a degree greater than the degree the angled sections are angled relative to the longitudinal axis. For example, the angled sections may be angled at about 45 degrees while the inclined sections are angled greater than about 45 degrees, and preferably at about 68 degrees. The radially outer most angled portion may be shared by all wedge sections. As with the prior embodiment, the plurality of angled portions are spaced apart radially and positioned sequentially in the longitudinal direction.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
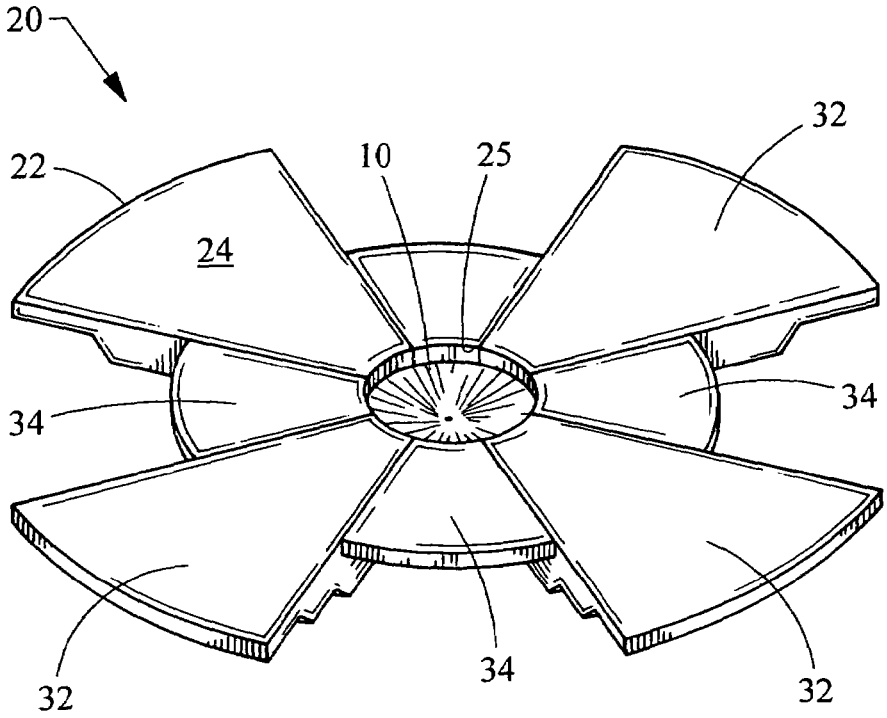
FIG. 1 is a perspective view of a light manifold constructed in accordance with the teachings of the present invention.
Figure 2:
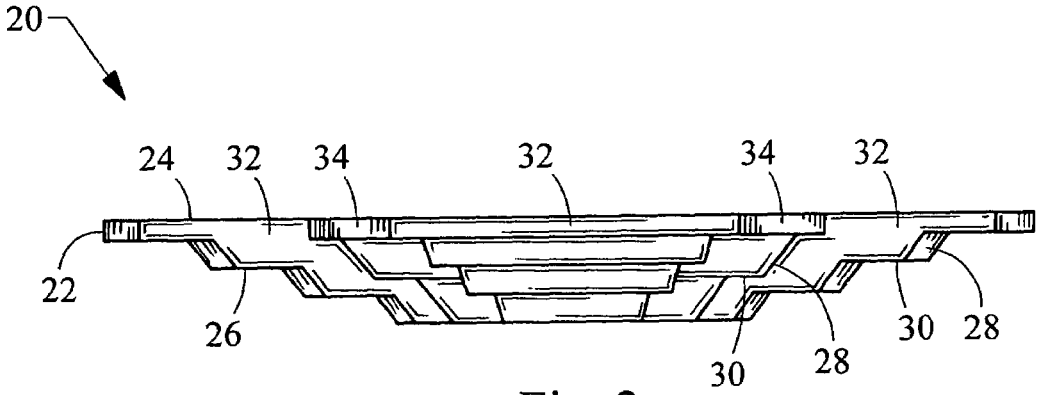
FIG. 2 is side view of the light manifold depicted in FIG. 1.
Figure 3:
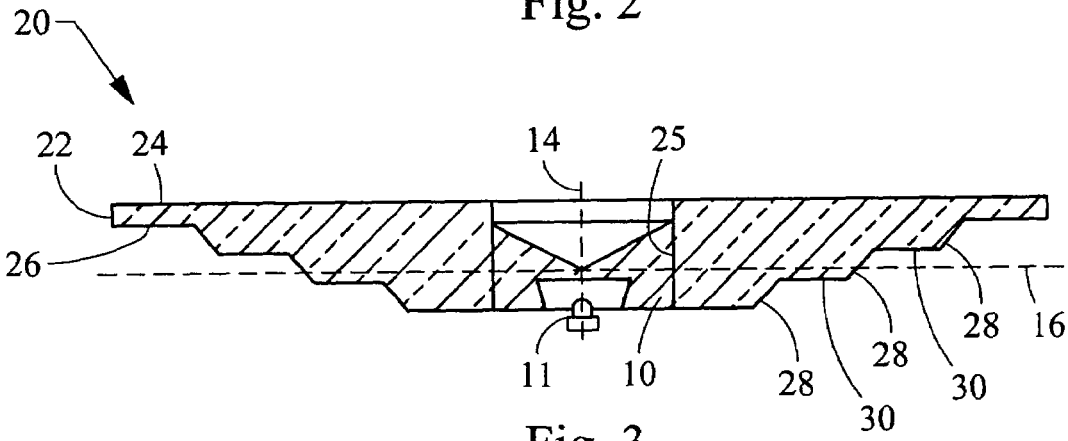
FIG. 3 is a cross-sectional view of the light manifold depicted in FIGS. 1 and 2.

Turning now to the figures, FIGS. 1–3 depict a light manifold 20 for use with the light module having a near field lens 10 and light source 11. Generally, the light manifold includes a disc-shaped main body 22 constructed of a light transmitting material, and preferably a plastic such as acrylic although any light transmitting material may be employed. The main body 22 defines a longitudinal axis 14 along which light is directed, and a lateral axis 16 perpendicular to the longitudinal axis 14. As used herein, the lateral direction may also be referred to as the radial direction, and encompasses all directions which are generally transverse to the longitudinal axis 14. The main body includes a light emitting surface 24 and a light reflecting surface 26. The light reflecting surface 26 will be referred to herein as the first surface 26 and the light emitting surface 24 will be referred to as the second surface 24. The main body 22 also includes an inner laterally facing surface 25 defining a pocket receiving the near field lens 10. Generally the inner laterally facing surface 25 is flat and annular, corresponding to the flat and annular outer surface of the near field lens 10.

The main body 22 of the manifold 20 receives light from the light source 11 and near field lens 10 through the inner laterally facing surface 25 for further redirection by the first surface 26. The near field lens 10 is preferably constructed as a side-emitting NFL, one preferred construction being described in copending U.S. patent application Ser. No. 11/274,071 filed on Nov. 15, 2005 concurrently herewith, the disclosure of which is incorporated herein by reference in its entirety. Generally, the NFL 10 is structured to collect, longitudinally collimate and redirect the light laterally along the lateral axis 16, and may be separately formed or integrally formed with the manifold 20. The first surface 26 includes a series of alternating angled portions 28 and lateral portions 30. The angled portions 28 are angled relative to both the longitudinal and lateral axes for reflecting light towards the second surface 24. Preferably, the angled portions 28 are angled at about 45 degrees although a wide variety of angles may be employed to provide a certain beam spread or pattern depending on the particular automotive function desired. The lateral portions 30 are generally parallel to the lateral axis 16, and therefore typically do not reflect the light. By the terms generally and about, it is meant that the surfaces are generally within 3 degrees of perfectly parallel or perpendicular. It will also be seen that the angled portions 28 are positioned sequentially moving in the longitudinal direction (i.e. along axis 14) to redirect the light longitudinally at different lateral or radial positions.

As best seen in FIGS. 1 and 2, the main body 22 includes a plurality of wedge sections, which here have been depicted as alternating first wedge sections 32 and second wedge sections 34. The first and second wedge sections 32, 34 span different radial lengths. Similarly, the first and second wedge sections 32 also include alternating angled portions 28 and lateral portions 30 which are positioned at different radial locations. It can also be seen that the first and second wedge sections 32, 34 include different numbers of angled portions 28. For example, the first section 32 has been depicted as having three angled portions 28, while the second wedge section 34 has been depicted as having only two angled portions 28.

Accordingly, it will be recognized that those skilled in the art that the light manifold 20 may be constructed out of any number of different wedge sections 32, 34 having any number of different angled portions 28 which can also be positioned at various radial positions and at various angles. All of these variables thus provide increased adaptability and the opportunity for uniquely creating a light distribution pattern or beam spread which achieves a certain function or application, like a particular light assembly of an automobile such as a stop light, brake light, turn light or the like.

Figure 4:
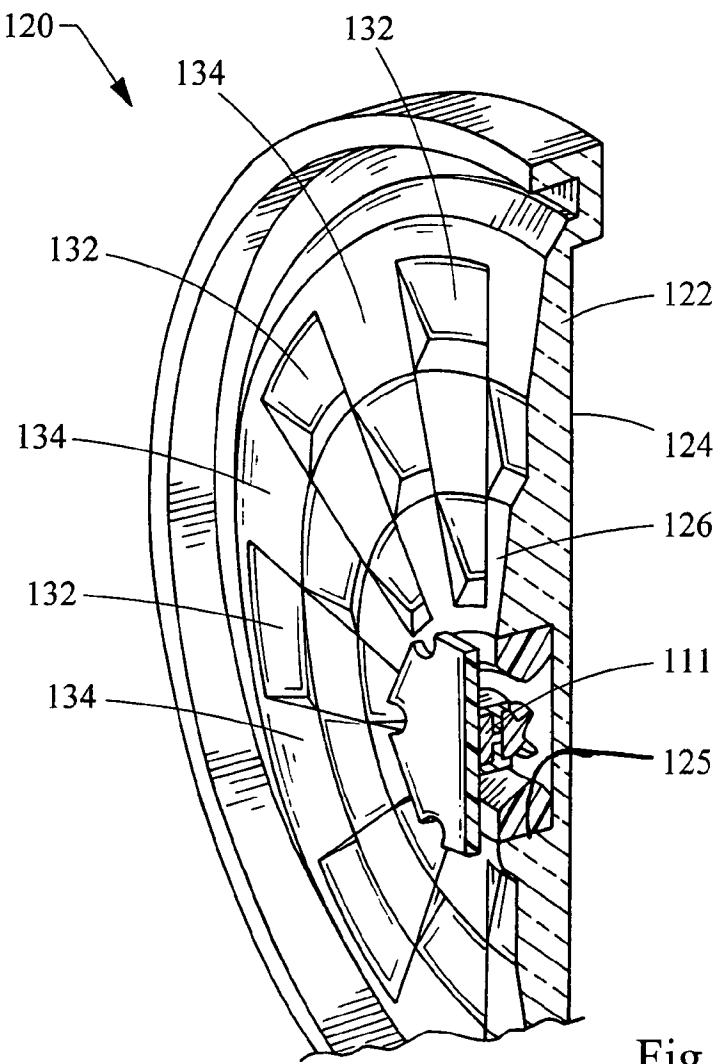
FIG. 4 is a perspective view, partially cut-away, of another embodiment of the light manifold constructed in accordance with the teachings of the present invention.
Figure 5:
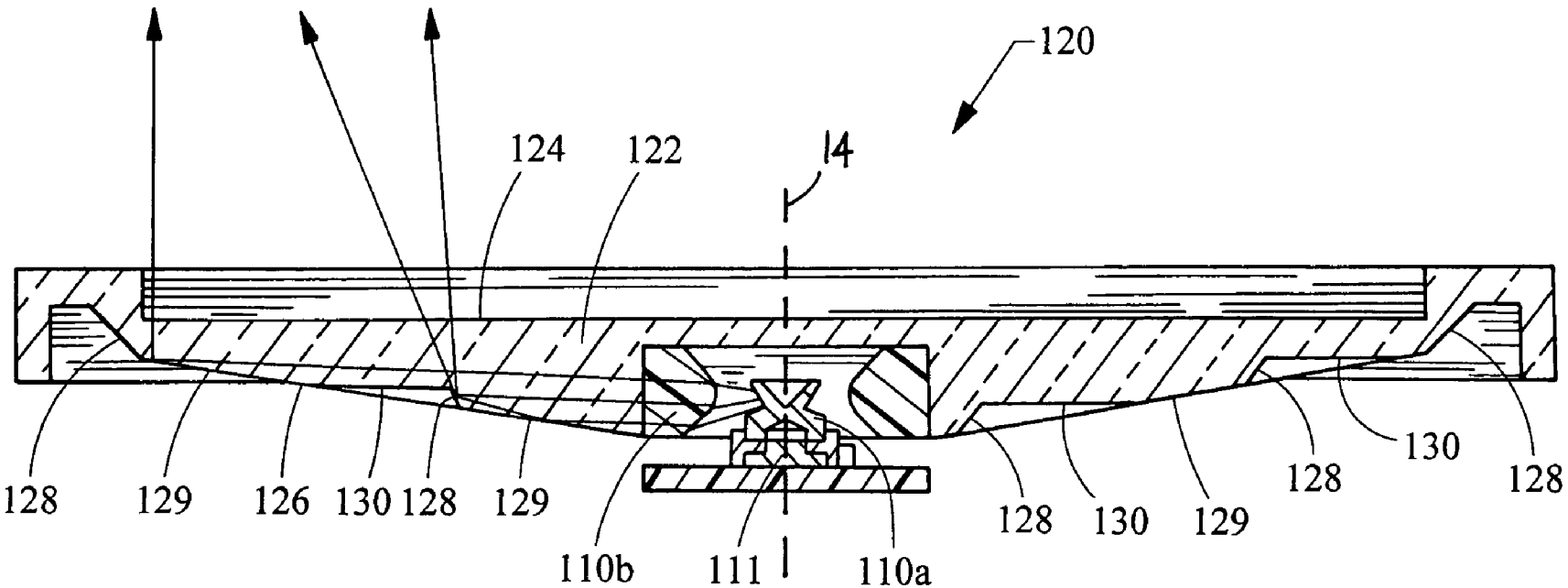
FIG. 5 is cross-sectional view of the light manifold depicted in FIG. 4.

Turning now to FIGS. 4 and 5, another embodiment of the light manifold 120 has been constructed in accordance with the teachings of the present invention. As with the prior embodiment, the light manifold 120 includes a main body 122 having a first surface 126 for redirecting light through a second surface 124. The main body 122 defines an inner laterally facing surface 125 receiving light from a light source 111 having a side emitting NFL. The main body 122 is circumferentially divided into a plurality of first and second wedge sections 132, 134 each having slightly different constructions. As with the prior embodiment, the first surface 126 is structured to include a plurality of alternating angled portions 128 and lateral portions 130.

Unlike the prior embodiment, the first surface 126 also includes a plurality of inclined portions 129 positioned between the angled portions 128 and lateral portions 130. The inclined portions 129 are angled at some degree relative to the longitudinal axis that is greater than the angle of the angled portions 128. Preferably, the inclined sections 129 are angled at about 68 degrees relative to the longitudinal axis 14. Thus, the first surface 126 follows a series including the angled portion 128, lateral portion 130 and inclined portion 129. In this manner, light is passing laterally through the main body 122 that strikes an inclined portion 129 will be redirected towards an angled portion 128 and reflected outwardly through the second surface 124, at some increased angle relative to the longitudinal axis 14. Accordingly, it will be recognized by those skilled in the art that through the provision of inclined portions 129, a controlled amount of beam spread is provided by the light manifold 120.

The first and second wedge sections 132, 134 differ in their radial spacing and size of angled portions 128, inclined portions 129 and lateral portions 130. Like the prior embodiment, increased control is provided over the resulting beam pattern through the use of different wedge sections 132, 134. It will also be recognized that the radially outer most angled portion 128 is shared by all of the first and second wedge sections 132, 134. As such, a solid ring of light is provided along the outer periphery and a common outer diameter to the main body 122 is provided.

Figure 6:
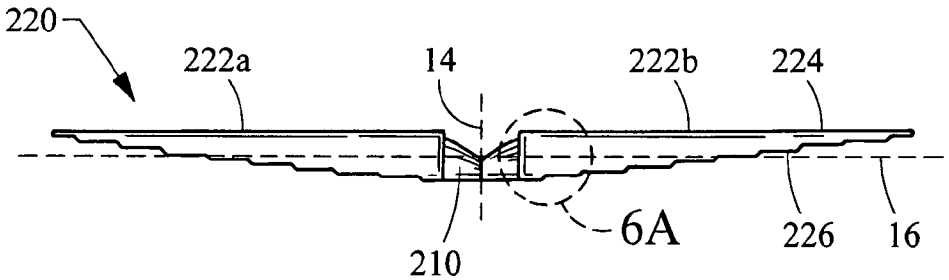
FIGS. 6 and **6*a*** are a side view and an enlarged portion of the side view of another embodiment of a light manifold constructed in accordance with the teachings of the present invention.
Figure 6A:
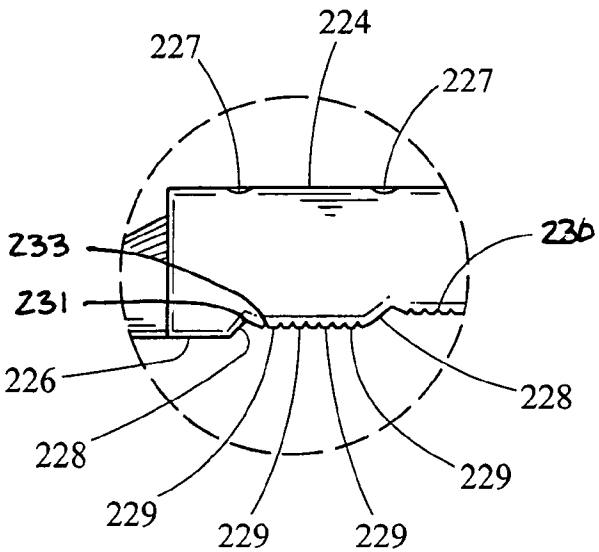

Turning now to FIGS. 6 and 6*a*, another embodiment of a light manifold 220 constructed in accordance with the teachings of the present invention has been depicted. The manifold 220 of this embodiment is structured for use with a near field lens 210 having a bi-directional lens construction, which is described in more detail in copending U.S. patent application Ser. No. 11/274,071 filed concurrently herewith. The NFL 210 is structured to direct light in two laterally opposite directions along a longitudinal axis 16. Accordingly, the manifold 220 includes a first body portion 222*a* and a second body portion 222*b* which are similarly constructed. Each main body portion 222 includes a first reflecting surface 226 and a second emitting surface 224.

As best seen in FIG. 6*a*, and similar to prior embodiments, the first surface 226 includes alternating angled portions 228 and lateral portions 230. However, in this embodiment, the lateral portions 230 include a plurality of ridges 229 structured to reflect incident light towards the second surface 224. In this manner, light distribution efficiency is improved. As shown in the figure, the angled portion 228 includes an upper longitudinal edge 231 and the plurality of ridges each have an upper longitudinal edge 233. Generally, the lateral portion 230 and the upper edges 233 of the ridges 229 are positioned below the upper longitudinal edge 231 of the angled portion 228. In this manner, the lateral portion 230 is somewhat shielded by the angled portion 228, and therefore only collects non-collimated or other incident light. It will also be recognized that the second light emitting surface 224 includes a plurality of dimples 227 which are structured to focus certain portions of the emitted light. Preferably, the dimples 227 are positioned in lateral alignment and longitudinally above the angled portions 228. It will be recognized that any number of different beam focusing or spreading optics may be employed on the second surface 224 of the light manifold 220.

Accordingly, it will be recognized by those skilled in the art that the various light manifold constructions described herein provide numerous opportunities for customization and hence constructions which can address particular light distribution requirements such as for automotive functions.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A light manifold for an automotive light module having a light source, the light manifold comprising:

a main body of light transmitting material, the main body defining a longitudinal axis and a lateral axis;

the main body having opposing first and second surfaces, the first and second surfaces generally facing longitudinally;

the first surface having a series of alternating angled portions and lateral portions, the angled portions angled relative to both the longitudinal and lateral axes for reflecting light towards the second surface; and the lateral portions including a plurality of ridges structured to reflect incident light towards the second surface.

2. The light manifold of claim 1, wherein the lateral portions are generally parallel to the lateral axis.

3. The light manifold of claim 1, wherein the angled portions are angled about 45 degrees relative to both the longitudinal and lateral axes.

4. The light manifold of claim 1, wherein each angled portion has an upper longitudinal edge, and the plurality of ridges have upper longitudinal edges positioned lower than the upper longitudinal edge of an adjacent radially inward angled portion.

5. The light manifold of claim 1, wherein the plurality of ridges are defined by V-shaped grooves formed into the first surface of the main body.

6. The light manifold of claim 1, wherein the angled portions are positioned sequentially in the longitudinal direction.

7. The light manifold of claim 1, wherein the main body is annular in shape.

8. The light manifold of claim 7, wherein the annular main body includes an interior passageway defined by a flat laterally facing surface receiving light from the light source.

9. The light manifold of claim 8, further comprising a near field lens having a flat outer laterally facing surface abutting against the laterally facing surface of the main body.

10. A light manifold for an automotive light module having a light source, the light manifold comprising:

a main body of light transmitting material, the main body having a disc shape defining a longitudinal axis, the main body having opposing first and second surfaces generally facing longitudinally;

the main body circumferentially divided into a plurality of wedge sections, each wedge section having a series of radially spaced apart angled portions formed into the first surface, the angled portions being angled relative to the longitudinal axis for reflecting light towards the second surface; and the radial spacing of the angled portions of a first wedge section being different than the radial spacing of the angled portions of a second wedge section.

11. The light manifold of claim 10, wherein each wedge section has a radial length, and wherein the radial length of the first wedge section is different than the radial length of the second wedge section.

12. The light manifold of claim 11, wherein the plurality of wedge sections alternate between the first and second wedge sections.

13. The light manifold of claim 10, wherein each wedge section further includes a series of radially spaced apart inclined sections, the inclined sections being angled relative to the longitudinal axis at a degree greater than the degree that the angled sections are angled relative to the longitudinal axis.

14. The light manifold of claim 10, wherein the angled sections are angled at about 45 degrees.

15. The light manifold of claim 13, wherein the inclined sections are angled at greater than about 45 degrees.

16. The light manifold of claim 13, wherein the inclined sections are angled at about 68 degrees.

17. The light manifold of claim 10, wherein the radially outermost angled portion is shared by all wedge sections.

18. The light manifold of claim 10, further comprising a plurality of ridges formed into the first surface between the angled portions, the ridges structured to reflect incident light towards the second surface.

19. The light manifold of claim 10, wherein the plurality of angled portions are spaced apart radially and positioned sequentially in the longitudinal direction.

20. The light manifold of claim 10, wherein the first and second wedge section are adjacent each other.

* * * * *